United States Patent [19]

Mützell

[11] Patent Number: 4,937,898

[45] Date of Patent: Jul. 3, 1990

[54] HYDRAULIC MASSAGE METHOD

[76] Inventor: Theodor Mützell, 7 Senator Street, Hobart, Tasmania, Australia

[21] Appl. No.: 219,282

[22] Filed: Jul. 14, 1988

Related U.S. Application Data

[62] Division of Ser. No. 556,708, filed as PCT AU82/00164 on Oct. 7, 1982 published as WO83/01896 on Jun. 9, 1983 now Pat. No. 4757,562.

[30] Foreign Application Priority Data

Dec. 3, 1981 [DE] Fed. Rep. of Germany ..... 3147798

[51] Int. Cl.[5] ..... A47K 3/22

[52] U.S. Cl. ..... 4/615; 4/542; 128/66

[58] Field of Search ..... 4/615, 492, 541, 542; 128/66, 65

[56] References Cited

U.S. PATENT DOCUMENTS

| | | | |
|---|---|---|---|
| 4,607,405 | 8/1986 | Ellis et al. | 128/66 X |
| 4,757,562 | 7/1988 | Mutzell | 4/543 X |
| 4,757,808 | 7/1988 | Effler | 4/492 X |

FOREIGN PATENT DOCUMENTS

| | | | |
|---|---|---|---|
| 0081068 | 10/1982 | European Pat. Off. . | |
| 0107661 | 10/1982 | European Pat. Off. . | |
| 213041 | 5/1968 | Fed. Rep. of Germany | 4/541 |
| 2601506 | 7/1977 | Fed. Rep. of Germany | 4/541 |
| 2641469 | 10/1978 | Fed. Rep. of Germany | 128/66 |
| 3147798 | 10/1983 | Fed. Rep. of Germany . | |
| 3212319 | 10/1983 | Fed. Rep. of Germany | 128/66 |
| 8200164 | 1/1982 | PCT Int'l Appl. . | |

OTHER PUBLICATIONS

"der Deutsche badebetrieb," 11 Nov. 1982, Von Dr. Med. Willy Zimmermann.

Journal of Rehabilitation Research, 1982 pp. 545–548.

Big Advance in Massage, Enterprise vol. 2, No. 5, Published 1984 by the Tasmanian Development Authority.

*Primary Examiner*—Charles E. Phillips

[57] ABSTRACT

A hydraulic massage method in which a spray enclosure consisting of a drainage hood and a sump and at least one spray nozzle controlled by a coordinate guide. A patient is placed upon the readily deformable impact area and is separated from direct contact with the working fluid. The patient support may consist of a flexible screen in the form of a tensioned cable grid supported by a frame on supports. The sump may be bounded by a perforated draining partition splitting of an additional compartment of the sump named reservoir. Fluid drained into the sump and the reservoir, if any, may be reused.

1 Claim, 1 Drawing Sheet

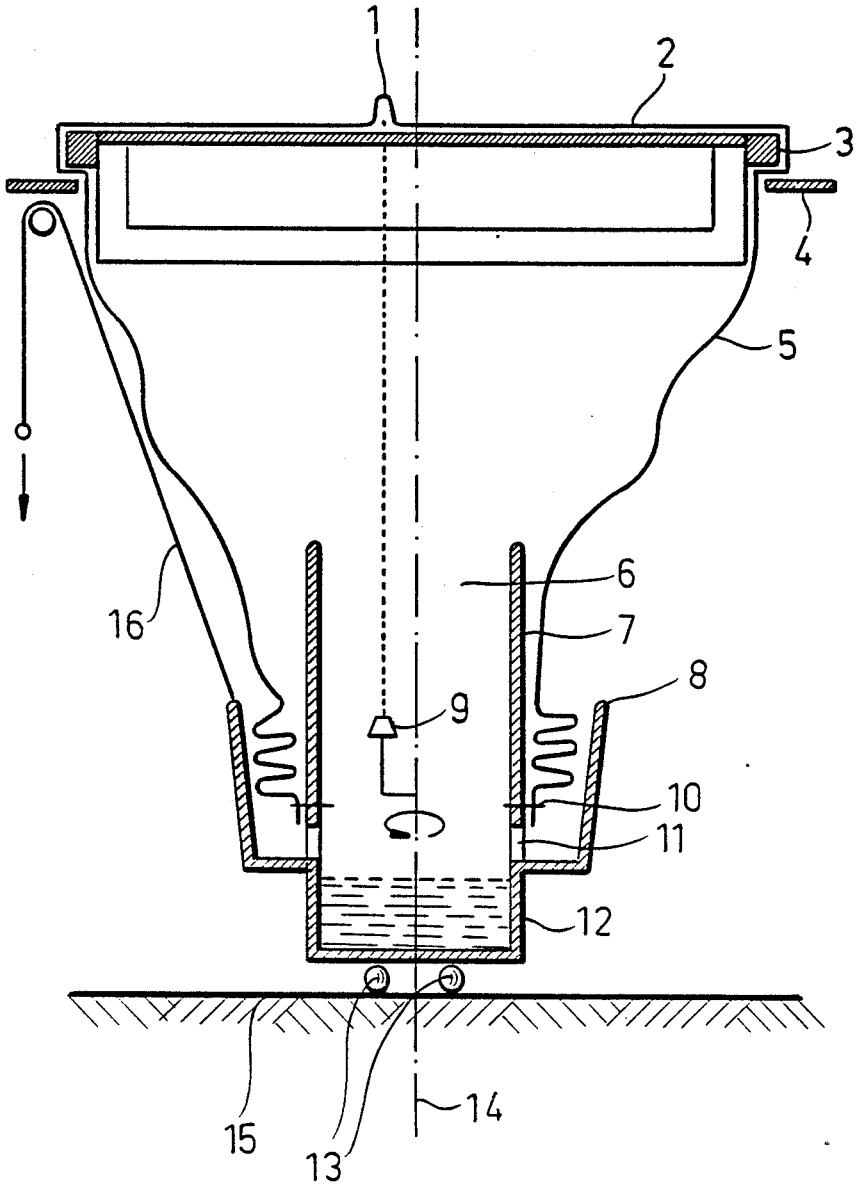
1
2
3
4
5
6
7
8
9
10
11
12
13
14
15
16

HYDRAULIC MASSAGE METHOD

CROSS REFERENCE TO RELATED APPLICATIONS

This application is a division of Ser. No. 06/556,708 filed as a national phase application corresponding to PCT/AU82/00164 filed 7 Oct. 1982 and based in turn upon a German national application P31 47 798.4 of 3 Dec. 1981 (now U.S. Pat. No. 4,757,562 issued 16 July 1988.

FIELD OF THE INVENTION

The present invention relates to a hydraulic massage method using a device which comprises a spray enclosure, containing a readily deformable impact area which keeps the working fluid separate from the body to be massaged and which faces this body directly or indirectly with its surface n in touch with the fluid, and at least one spray nozzle.

BACKGROUND OF THE INVENTION

I have found the following prior art to be relevant:

(1) German Open Application DE-OS-2641469

(2) German Open Application DE-OS-2601506

(3) German Patent DE-PS 213041.

The process and device according to DE-OS 2641469 may help to economize on water and energy. They cause, however, a pollution of the working fluid, a risk of infection in spite of cleaning after each application, indefinite strain energy due to varying directions of the jet on the impacted areas, and a nuisance from splashing water to the patient and physiotherapist.

The jet massaging device according to DE-OS 2601506 economizes on water and energy; moreover the risk of infection is generally smaller because the impact area is a partition.

However, the device has the disadvantage that, because of the rather small distance between the nozzle and the impact area and the decelerating effect of the stored water that must be passed by jet, lower pressures are available at the impact area for a given pump power.

Especially disadvantageous is, however, the fact that relative movements between the elastic membrane of the device and the connective tissue are necessary during the treatment which may cause disadvantageous tangential strain upon the tissue and even the formation of lesions. Finally a precise guide of the pistol-grip handle requires extraordinary ability of the physiotherapist.

The arrangement of the nozzle according to DE-PS 213041 alloWs considerable energy and water economies without incurring mechanical or infectious risks for the patient. Here, however, the following disadvantages are found:

1. The bag making up the spray enclosure does not allow sufficient straight movement of the nozzle. Access to the interior for service is difficult.

2. The inclination of the impact vectors changes from one point to the next.

3. From a practical point of view, it appears to be impossible to achieve specified directions of the jet as accurately as required for steady massaging without making use of sophisticated three-dimensional control devices, the more so as an optical control by means of the patient's body is ruled out be deflection of light by spray water drops, even if the bag is assumed to be transparent.

4. Variable aberrations in inclination of the nozzle's axis initiate different consequences as distances between the nozzle and the area impacted change.

5. The total weight of the membrane forming the impact area counteracts the transmitting jet; consequently, relatively small thin impact areas are demanded. On the other hand, the limitation of the maximal strain which is permissible requires relatively thick membranes during operation.

OBJECT OF THE INVENTION

It is the object of the invention to provide a method or process which is an improvement over that of DE-PS 213041, allowing easy access and a steadier hydraulic massaging suitable for automatic control and larger working areas, which correspond to larger areas of the body, the inclination of the jet stream being held constant throughout the total working area, if required.

SUMMARY OF THE INVENTION

The massager of the invention comprises a spray enclosure which consists of a drainage hood enclosing an impact area, of a sump and of a spray nozzle, the position of which is controllable by means of a coordinate guide.

Advantageously the impact area, simultaneously forms a support for the body to be massaged and a flexible screen serves as a support for that part of the hood forming the impact area and which carries most of the body weight.

The screen can be formed by a tensioned cable grid supported by a frame.

BRIEF DESCRIPTION OF THE DRAWING

The sole FIGURE of the drawing is a diagrammatic cross section.

SPECIFIC DESCRIPTION

The apparatus comprises a generally horizontal impact area 1 which can be formed by material of the hood 5 and is supported by a screen 2, preferably a cable grid, in a frame 3. A support 4 is provided for the frame 3, the hood 5, e.g. a silicone sheet gathered around a lower opening defines an inner chamber 6. A perforated partition 7 separates a chamber 11 of a sump 8, in which the liquid from the hood is collected, from a reservoir 12.

A spray nozzle 9 is trained upwardly in the sump 8. The locking means 10, e.g. a safety bolt for part 5 is also provided. Two wheels 13 support the sump on a surface 15. The apparatus has a plane of symmetry of the spray enclosure perpendicular to the drawing plane. A flexible support 16, e.g. a sheet of polyethylene or PVC for two surfaces of part 5 facing each other can also be provided The longitudinal axis of the human body treated can be imagined to be perpendicular to the drawing plane, the nozzle 9 rotating about an axis defined by the line of intersection formed by the plane of symmetry 14 and the drawing plane and gliding perpendicularly to the drawing plane.

The simultaneous rotation of the nozzle 9 around the axis and displacement of the nozzle perpendicular to the drawing plane will cause the jet projected by the nozzle 9 to describe a cycloid on the impact area 1.

If the spray enclosure is shifted in the drawing plane by means of the wheels 13 along the support surface 15, the nozzle 9 which is thus carried along will describe a second cycloidal curve parallel to the first and precisely corresponding to the rate of movement taking place.

The cable grid 2 carries most of the body weight lying upon the hood 5 in the treated and impacted areas. It thus counteracts deflection of the hood 5, permitting an exceptionally lightweight design thereof, so that the hood will be readily deformable in the impact area 1, improved flexibility of the lateral areas, and indirectly an improved mobility of the spray enclosure as a whole along the support 15 in the drawing plane.

The mobility is also improved by the design of the hood itself. The outer chamber 11 can store folds. If a preferably flexible support 16, e.g. a sheet, is tied to the sump 8 serving as an outer limit for the hood 5 at the lateral areas, a self-regulating storage for folds will be created if the said support 16 is turned around beneath the support 4 and stretched at its vertical portion (as represented at T) by means of a weight; thus maximal storage is achieved whenever maximal opening angles occur, i.e. whenever the need for storage arises, making storage easier and safer.

In order to avoid potential energy produced by elevation of the said weight, an analogous, counteracting opposite storage for folds is suggested. For the sake of clarity, a symmetric sketch has been omitted.

The raised perforated partition 7 may simultaneously serve to drain collected water into the reservoir 12, guide the folds by means of its upper part and as a fixing medium, e.g. clamp, in its lower part.

The device according to this invention is especially suitable for applications in combination with a known coordinate control system. (Cf. e.g. the scheme of the German Industrial standard DIN 40719, page 6).

The invention has the following advantages:

The method uses a device which is easy to manufacture, prefabricate and service. The components required are either generally available in the trade or are readily made of low-priced, common materials.

Depending on the inclination of the nozzle, precisely dosed massages may be applied to the muscles or, alternatively, to the connective tissue. On the other hand, precise doses of strain energy are an indispensable condition for any linked precise heat transfer.

The screen forms a spring support for the hood and moreover allows the use of a thin hood having a large working surface combined with low strain, even if extremely heavy patients are placed upon the hood.

Furthermore pipes instead of hoses may easily be used for water supply and drainage; the risk of such a pipe bursting does not exceed that associated with pipes commonly used in home installations; hence the new combination may equally well be used in normal workrooms hitherto reserved for manual, i.e. "dry" massages.

The coordinate guide improves the accuracy of treatment and increases comfort considerably.

The new device will release physiotherapists from heavy, injurious labor and stooping so that even the partially disabled may regularly massage with the aid of the invention.

Risks of infection which do exist in tubs for underwater physiotherapy are entirely eliminated for cleaners.

The time for filling and emptying the reservoir and occasional cleaning is spread over a large number of patients.

A big tub requiring a legally prescribed volume of at least 400–600 liters per single underwater treatment is superfluous, since about forty liters of recycled water will not be sufficient. Hence, water consumption per treatment drops to below one liter, i.e. to thousandths of the usual quantity.

Furthermore, the new device allows outstanding energy savings.

I claim:

1. A hydraulic massage method which comprises the steps of:

(a) supporting the body of an individual above a water-collecting receptacle on a support structure having openings;

(b) interposing between said support structure and said body a sheet of support structure and forming a flexible surface above said support structure upon which the body of the individual can repose;

(c) training water upwardly toward said surface from a nozzle mounted in said receptable for directing a jet of water against said surface whereby said individual is massaged through said surface with said jet and water falling from said surface is collected in said receptacle; and (d) displacing said nozzle in at least two directions of a coordinate system to sweep said jet against said surface, said nozzle being rotated about an axis and being displaced horizontally so that said jet describes at least one cycloidal pattern against the underside of said surface.

* * * * *